US008847864B2

(12) United States Patent
Zhang et al.

(10) Patent No.: US 8,847,864 B2
(45) Date of Patent: Sep. 30, 2014

(54) COLOR FLAT DISPLAY PANEL AND CORRESPONDING COLOR FLAT DISPLAY DEVICE HAVING GAMMA REFERENCE VOLTAGES FOR RED, GREEN AND BLUE COLORS

(75) Inventors: Yong Zhang, Shenzhen (CN); Dong-Sheng Guo, Shenzhen (CN)

(73) Assignee: Shenzhen China Star Optoelectronics Technology Co., Ltd., Shenzhen, Guangdong Province ( * ) Notice: Subject to any disclaimer, the term of this patent is extended or adjusted under 35 U.S.C. 154(b) by 335 days.

(21) Appl. No.: 13/380,902

(22) PCT Filed: Dec. 5, 2011

(86) PCT No.: PCT/CN2011/083445

§ 371 (c)(1), (2), (4) Date: Dec. 26, 2011

(87) PCT Pub. No.: WO2013/075364

PCT Pub. Date: May 30, 2013

(65) Prior Publication Data

US 2013/0135186 A1 May 30, 2013

(30) Foreign Application Priority Data

Nov. 24, 2011 (CN) ..... 2011 1 0378963

(51) Int. Cl.
*G09G 3/36* (2006.01)

(52) U.S. Cl.
USPC ..... 345/88

(58) Field of Classification Search
USPC ..... 345/88
See application file for complete search history.

(56) References Cited

U.S. PATENT DOCUMENTS

| | | | | |
|---|---|---|---|---|
| 6,879,310 | B2 | 4/2005 | Nose | |
| 2002/0163490 | A1 * | 11/2002 | Nose | 345/89 |
| 2008/0303767 | A1 * | 12/2008 | Ludden et al. | 345/89 |
| 2010/0039453 | A1 * | 2/2010 | Chaji et al. | 345/690 |

FOREIGN PATENT DOCUMENTS

| | | | |
|---|---|---|---|
| CN | 1499828 | A | 5/2004 |
| CN | 1758319 | A | 4/2006 |
| CN | 1954352 | A | 4/2007 |
| CN | 1954353 | A | 4/2007 |
| CN | 201204028 | Y | 3/2009 |
| CN | 102216835 | A | 10/2011 |
| JP | 2006-317566 | A | 11/2006 |

* cited by examiner

*Primary Examiner* — Long D Pham
(74) *Attorney, Agent, or Firm* — Cheng-Ju Chiang

(57) ABSTRACT

A color flat display panel and a corresponding color flat display device are disclosed. The color flat display panel comprises a plurality of pixels, a plurality of scanning lines and a plurality of data lines. Each of the pixels comprises a first color sub-pixel, a second color sub-pixel and a third color sub-pixel, each of the scanning lines is electrically connected with a corresponding row of sub-pixels in a row direction, and each of the data lines is electrically connected with a corresponding column of sub-pixels in a column direction. The first color sub-pixel, the second color sub-pixel and the third color sub-pixel of each of the pixels are arranged in the column direction so that the corresponding row of sub-pixels electrically connected with each of the scanning lines are sub-pixels of a same color. As sub-pixels of each row are of a same color, each sub-pixel can receive a Gamma curve of the same color, thus obviating the color-cross.

9 Claims, 6 Drawing Sheets

COLOR FLAT DISPLAY PANEL AND CORRESPONDING COLOR FLAT DISPLAY DEVICE HAVING GAMMA REFERENCE VOLTAGES FOR RED, GREEN AND BLUE COLORS

FIELD OF THE INVENTION

The present disclosure generally relates to the technical field of flat panel displaying technologies, and more particularly, to a color flat display panel and a corresponding color flat display device.

BACKGROUND OF THE INVENTION

Owing to their advantages such as lightweight, thin-profile and energy-saving, color flat display devices such as liquid crystal display (LCD) devices have gradually replaced the conventional cathode ray tube (CRT) display devices as the mainstream display products. Currently, the LCD devices have found wide applications in various electronic apparatuses including digital TV sets, computers, personal digital assistants (PDAs), mobile phones and digital cameras.

FIG. 1 is a schematic view of a conventional LCD panel in an LCD device. As shown in FIG. 1, the conventional LCD panel 100 comprises a plurality of pixels 110, each of which comprises an R sub-pixel, a G sub-pixel and a B sub-pixel disposed in a same row. The LCD panel 100 also comprises a plurality of scanning lines (not labeled) and a plurality of data lines (not labeled). Each of the scanning lines is electrically connected to a corresponding row of sub-pixels, and each of the data lines is electrically connected to a corresponding column of sub-pixels. The scan lines are scanned row by row according to a timing sequence to activate each row of sub-pixels sequentially, and data voltages are written into corresponding rows of sub-pixels via the data lines so that different grayscales are displayed by the sub-pixels to display a frame on the LCD panel 100.

At present, a same Gamma curve is adopted for the R sub-pixels, the G sub-pixels and the B sub-pixels in the LCD panel 100; in other words, voltages required by the R sub-pixels, the G sub-pixels and the B sub-pixels are completely the same at a same grayscale level. However, as found by the present inventor through researches, the three primary colors R, G and B have different Gamma curves as shown in FIG. 2. Therefore, a color displayed by the pixel 110 (comprising three sub-pixels R, G, and B) when the R sub-pixel, the G sub-pixel and the B sub-pixel are at the same grayscale level is not a kind of gray color theoretically ranging between the black color and the white color, but more of a blue color.

In the conventional LCD panel 100, the R sub-pixel, the G sub-pixel and the B sub-pixel in one pixel are arranged horizontally, i.e., in a same row. Therefore, when a scanning line corresponding to a certain row is enabled to activate sub-pixels of this row, the R sub-pixels, the G sub-pixels and the B sub-pixels in this row receive data voltages from a source drive integrated circuit (IC) simultaneously. In other words, the source drive IC provides data voltages to the R sub-pixels, the G sub-pixels and the B sub-pixels in a row simultaneously. FIG. 3 is a schematic view of a conventional source drive IC. As shown in FIG. 3, the source driver IC 300 comprises a bi-directional shift register 310, a line buffer 320, a level shifter 330, a digital-to-analog converter (DAC) 340 and a buffer 350 connected as shown in FIG. 3. The DAC 340 further receives a Gamma reference voltage to convert grayscale data received into corresponding voltage data according to the Gamma reference voltage. However, as described above, the source drive IC 300 needs to output data voltages of one row to individual sub-pixels of this row simultaneously, and the sub-pixels in this row include R sub-pixels, G sub-pixels and B sub-pixels. Therefore, the Gamma reference voltage received by the source drive IC 300 at a certain time point only corresponds to a Gamma curve of one of the three primary colors R, G and B. In other words, the R sub-pixels, the G sub-pixels and the B sub-pixels in the same row correspond to still a Gamma curve of a single color, so the LCD panel 100 suffers from cross-color and cannot display colors authentically. Accordingly, an urgent need exists in the art to develop a novel color flat display panel and a corresponding color flat display device in order to make improvements on the aforesaid problem.

SUMMARY OF THE INVENTION

An objective of the present disclosure is to provide a color flat display panel and a corresponding color flat display device capable of obviating color-cross.

To achieve the aforesaid objective, the present disclosure provides a color flat display panel. The color flat display panel comprises: a plurality of pixels each comprising a first color sub-pixel, a second color sub-pixel and a third color sub-pixel, wherein the first color is a red (R) color, the second color is a green (G) color and the third color is a blue (B) color; a plurality of scanning lines, each of the scanning lines being electrically connected with a corresponding row of sub-pixels in a row direction; and a plurality of data lines, each of the data lines being electrically connected with a corresponding column of sub-pixels in a column direction. The first color sub-pixel, the second color sub-pixel and the third color sub-pixel of each of the pixels are arranged in the column direction so that the corresponding row of sub-pixels electrically connected with each of the scanning lines are sub-pixels of a same color; and the color flat display panel uses a Gamma circuit to provide Gamma reference voltages for different colors, and the Gamma reference voltages correspond to the colors of the corresponding rows of sub-pixels electrically connected with the scanning lines.

Preferably, the Gamma circuit comprises: an interface control module; a storage module comprising a first storage unit, a second storage unit and a third storage unit, wherein the storage module is configured to receive a Gamma voltage conforming to a first color Gamma curve, a Gamma voltage conforming to a second color Gamma curve and a Gamma voltage conforming to a third color Gamma curve for the color flat display panel via the interface control module, and store the Gamma voltage conforming to the first color Gamma curve, the Gamma voltage conforming to the second color Gamma curve and the Gamma voltage conforming to the third color Gamma curve into the first storage unit, the second storage unit and the third storage unit of the storage module respectively; a selection module, being configured to select one of the first storage unit, the second storage unit and the third storage unit according to a timing sequence so that the Gamma voltage conforming to the first color Gamma curve, the Gamma voltage conforming to the second color Gamma curve and the Gamma voltage conforming to the third color Gamma curve are outputted according to the timing sequence; a digital-to-analog conversion (DAC) register, being configured to temporarily store the Gamma voltage conforming to the first color Gamma curve, the Gamma voltage conforming to the second color Gamma curve and the Gamma voltage conforming to the third color Gamma curve outputted by the storage module; a plurality of DAC modules, being electrically connected to the DAC register respectively, wherein each of the DAC modules is configured to receive a Gamma voltage of one color and convert the Gamma voltage of the color from a digital signal into an analog signal for use as the Gamma reference voltage of the corresponding color; and a plurality of buffers, each of which is electrically connected with a corresponding one of the DAC modules to output the Gamma reference voltage of the corresponding color, wherein the number of the DAC modules and the number of the buffers correspond to the number of the scanning lines of the color flat display panel, and the Gamma reference voltage of the corresponding color outputted by each of the buffers corresponds to the color of the corresponding row of sub-pixels electrically connected with a corresponding one of the scanning lines.

Preferably, the selection module comprises a first transistor, a second transistor and a third transistor, and each of the transistors has a gate for receiving a corresponding control signal, a source electrically connected to an enable signal, and a drain for outputting a control selection signal to one of the first storage unit, the second storage unit and the third storage unit.

Preferably, the color flat display panel is a liquid crystal display (LCD) panel.

To achieve the aforesaid objective, the present disclosure further provides a color flat display panel. The color flat display panel comprises: a plurality of pixels each comprising a first color sub-pixel, a second color sub-pixel and a third color sub-pixel; a plurality of scanning lines, each of the scanning lines being electrically connected with a corresponding row of sub-pixels in a row direction; and a plurality of data lines, each of the data lines being electrically connected with a corresponding column of sub-pixels in a column direction. The first color sub-pixel, the second color sub-pixel and the third color sub-pixel of each of the pixels are arranged in the column direction so that the corresponding row of sub-pixels electrically connected with each of the scanning lines are sub-pixels of a same color.

Preferably, the color flat display panel uses a Gamma circuit to provide Gamma reference voltages for different colors, and the Gamma reference voltages correspond to the colors of the corresponding rows of sub-pixels electrically connected with the scanning lines.

Preferably, the Gamma circuit comprises: an interface control module; a storage module comprising a first storage unit, a second storage unit and a third storage unit, wherein the storage module is configured to receive a Gamma voltage conforming to a first color Gamma curve, a Gamma voltage conforming to a second color Gamma curve and a Gamma voltage conforming to a third color Gamma curve for the color flat display panel via the interface control module, and store the Gamma voltage conforming to the first color Gamma curve, the Gamma voltage conforming to the second color Gamma curve and the Gamma voltage conforming to the third color Gamma curve into the first storage unit, the second storage unit and the third storage unit of the storage module respectively; a selection module, being configured to select one of the first storage unit, the second storage unit and the third storage unit according to a timing sequence so that the Gamma voltage conforming to the first color Gamma curve, the Gamma voltage conforming to the second color Gamma curve and the Gamma voltage conforming to the third color Gamma curve are outputted according to the timing sequence; a DAC register, being configured to temporarily store the Gamma voltage conforming to the first color Gamma curve, the Gamma voltage conforming to the second color Gamma curve and the Gamma voltage conforming to the third color Gamma curve outputted by the storage module; a plurality of DAC modules, being electrically connected to the DAC register respectively, wherein each of the DAC modules is configured to receive a Gamma voltage of one color and convert the Gamma voltage of the color from a digital signal into an analog signal for use as the Gamma reference voltage of the corresponding color; and a plurality of buffers, each of which is electrically connected with a corresponding one of the DAC modules to output the Gamma reference voltage of the corresponding color; wherein the number of the DAC modules and the number of the buffers correspond to the number of the scanning lines of the color flat display panel, and the Gamma reference voltage of the corresponding color outputted by each of the buffers corresponds to the color of the corresponding row of sub-pixels electrically connected with a corresponding one of the scanning lines.

Preferably, the selection module comprises a first transistor, a second transistor and a third transistor, and each of the transistors has a gate for receiving a corresponding control signal, a source electrically connected to an enable signal, and a drain for outputting a control selection signal to one of the first storage unit, the second storage unit and the third storage unit.

Preferably, the first color is an R color, the second color is a G color and the third color is a B color.

To achieve the aforesaid objective, the present disclosure further provides a color flat display device. The color flat display device comprises: a color flat display panel, comprising: a plurality of pixels each comprising a first color sub-pixel, a second color sub-pixel and a third color sub-pixel; a plurality of scanning lines, each of the scanning lines being electrically connected with a corresponding row of sub-pixels in a row direction; and a plurality of data lines, each of the data lines being electrically connected with a corresponding column of sub-pixels in a column direction; and a Gamma circuit. The first color sub-pixel, the second color sub-pixel and the third color sub-pixel of each of the pixels in the color flat display panel are arranged in the column direction so that the corresponding row of sub-pixels electrically connected with each of the scanning lines are sub-pixels of a same color; and the Gamma circuit is configured to provide the color flat display panel with Gamma reference voltages for different colors, and the Gamma reference voltages correspond to the colors of the corresponding rows of sub-pixels electrically connected with the scanning lines.

Preferably, the Gamma circuit comprises: an interface control module; a storage module comprising a first storage unit, a second storage unit and a third storage unit, wherein the storage module is configured to receive a Gamma voltage conforming to a first color Gamma curve, a Gamma voltage conforming to a second color Gamma curve and a Gamma voltage conforming to a third color Gamma curve for the color flat display panel via the interface control module, and store the Gamma voltage conforming to the first color Gamma curve, the Gamma voltage conforming to the second color Gamma curve and the Gamma voltage conforming to the third color Gamma curve into the first storage unit, the second storage unit and the third storage unit of the storage module respectively; a selection module, being configured to select one of the first storage unit, the second storage unit and the third storage unit according to a timing sequence so that the Gamma voltage conforming to the first color Gamma curve, the Gamma voltage conforming to the second color Gamma curve and the Gamma voltage conforming to the third color Gamma curve are outputted according to the timing sequence; a DAC register, being configured to temporarily store the Gamma voltage conforming to the first color Gamma curve, the Gamma voltage conforming to the second color Gamma curve and the Gamma voltage conforming to the third color Gamma curve outputted by the storage module; a plurality of DAC modules, being electrically connected to the DAC register respectively, wherein each of the DAC modules is configured to receive a Gamma voltage of one color and convert the Gamma voltage of the color from a digital signal into an analog signal for use as the Gamma reference voltage of the corresponding color; and a plurality of buffers, each of which is electrically connected with a corresponding one of the DAC modules to output the Gamma reference voltage of the corresponding color; wherein the number of the DAC modules and the number of the buffers correspond to the number of the scanning lines of the color flat display panel, and the Gamma reference voltage of the corresponding color outputted by each of the buffers corresponds to the color of the corresponding row of sub-pixels electrically connected with a corresponding one of the scanning lines.

Preferably, the selection module comprises a first transistor, a second transistor and a third transistor, and each of the transistors has a gate for receiving a corresponding control signal, a source electrically connected to an enable signal, and a drain for outputting a control selection signal to one of the first storage unit, the second storage unit and the third storage unit.

Preferably, the interface control module comprises a data interface and a clock interface, and the Gamma voltage conforming to the first color Gamma curve, the Gamma voltage conforming to the second color Gamma curve and the Gamma voltage conforming to the third color Gamma curve are written into the first storage unit, the second storage unit and the third storage unit of the storage module respectively via the data interface and the clock interface of the interface control module.

According to the above descriptions, in the color flat display panel and the corresponding color flat display device of the present disclosure, the first color sub-pixel, the second color sub-pixel and the third color sub-pixel of each pixel are arranged in a column direction so that a row of sub-pixels electrically connected with each scanning line are all sub-pixels of a same color; and then a Gamma circuit is used to provide a Gamma reference voltage of a same color for the sub-pixels of the same color in each row. Thereby, each sub-pixel will correspond to a Gamma curve of its real color, thus obviating the color-cross.

What described above is only a summary of the present disclosure. In order to provide a better understanding of the technical solutions of the present disclosure so that the present disclosure can be practiced according to disclosures of this specification and in order to make the aforesaid and other objectives, features and advantages of the present disclosure more apparent, preferred embodiments of the present disclosure will be described hereinafter with reference to the attached drawings.

DETAILED DESCRIPTION OF THE INVENTION

Figure 1:
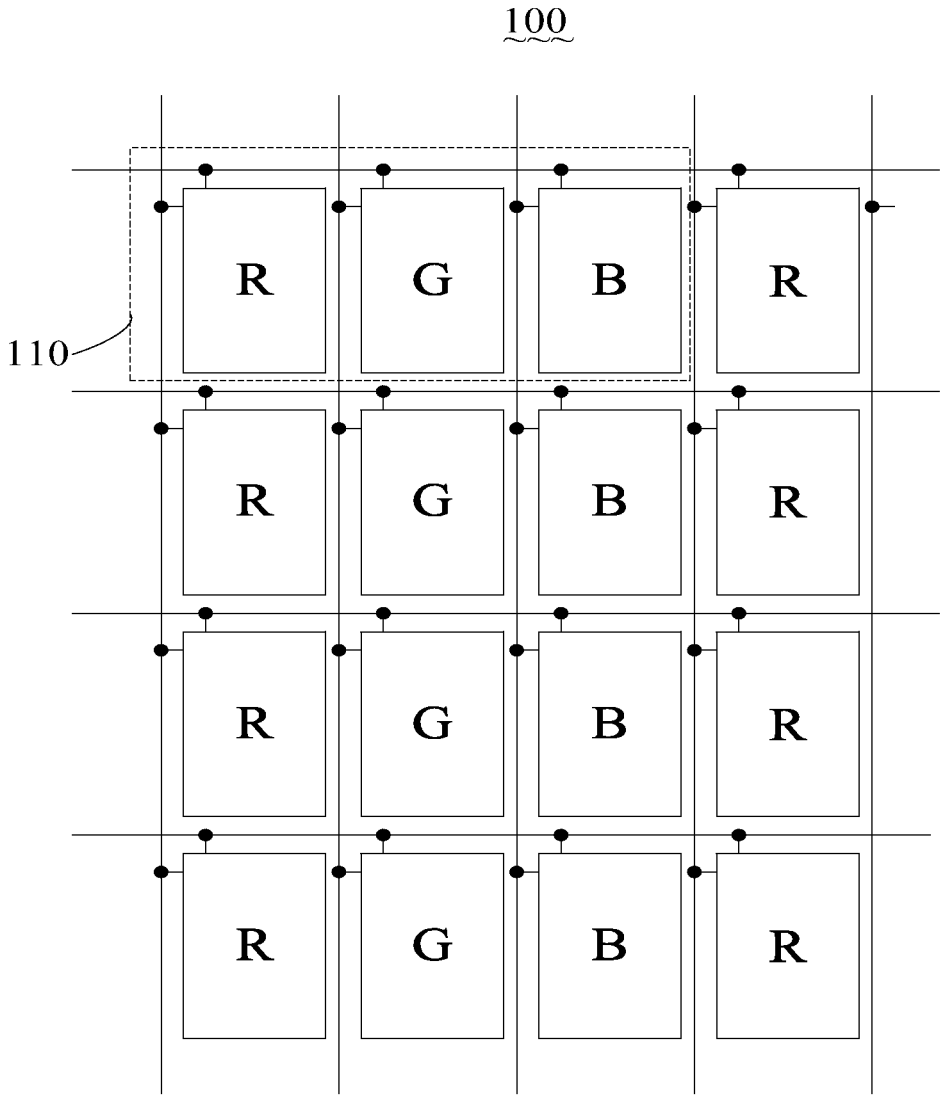
FIG. 1 (Prior Art)
FIG. 1 is a schematic view of a conventional LCD panel in an LCD device.
Figure 2:
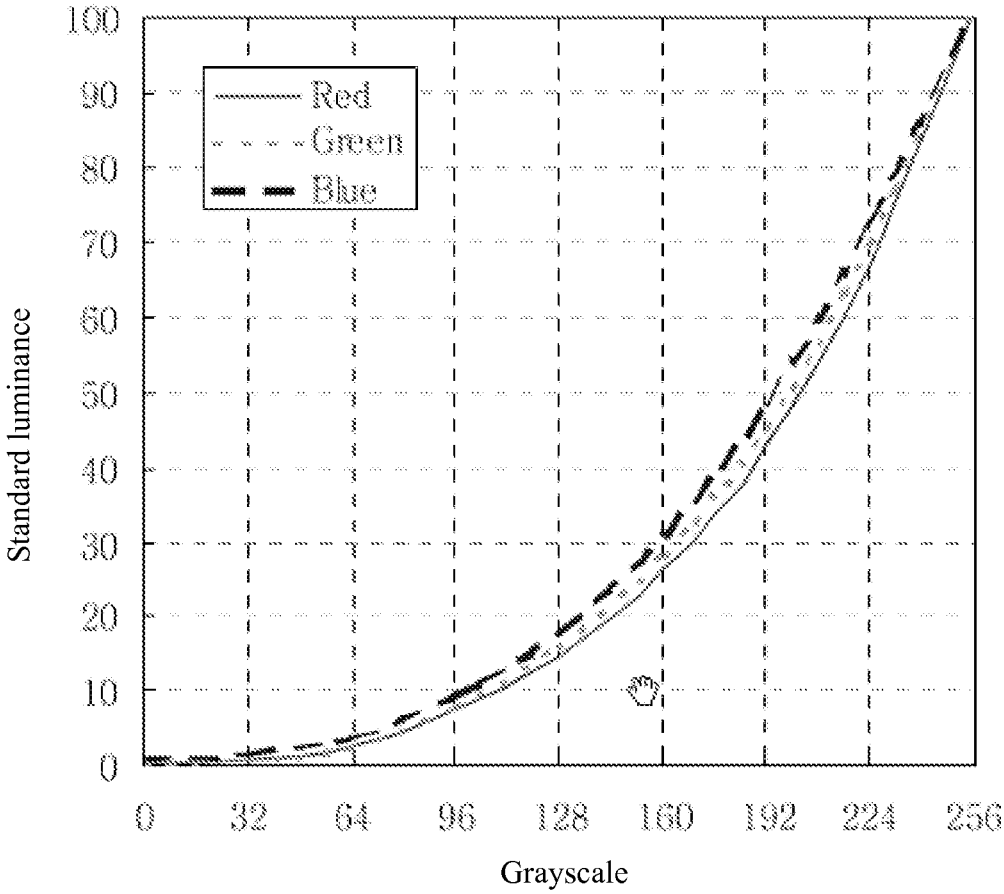
FIG. 2 (Prior Art)
FIG. 2 is a schematic view of Gamma curves of the three primary colors R, G and B.
Figure 3:
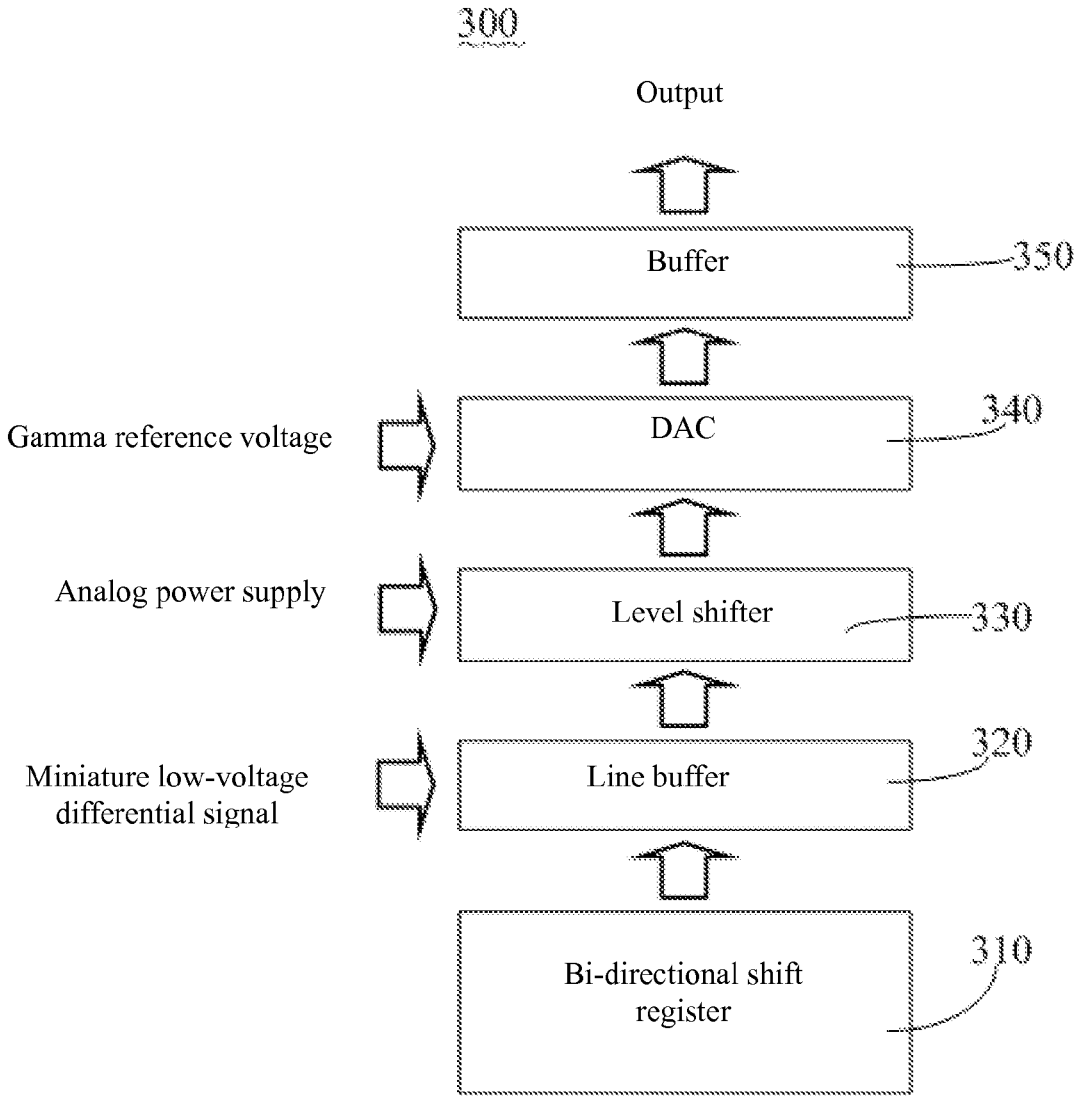
FIG. 3 (Prior Art)
FIG. 3 is a schematic view of a conventional source drive IC.

Various embodiments of the disclosure are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

In order to further describe the technical solutions adopted to achieve the objectives of the present disclosure and the efficacies thereof, implementations, methods, steps, structures, features and efficacies of the color flat display panel and the corresponding color flat display device according to the present disclosure will be detailed hereinbelow with reference to the attached drawings and preferred embodiments thereof. The aforesaid and other technical disclosures, features and efficacies of the present disclosure will become apparent from the following detailed description of the preferred embodiments that is made with reference to the attached drawings. The technical solutions and the efficacies thereof will be better understood by those of ordinary skill in the art upon reviewing the following description. However, the attached drawings are only provided for illustration purpose but not to limit the present disclosure.

Figure 4:
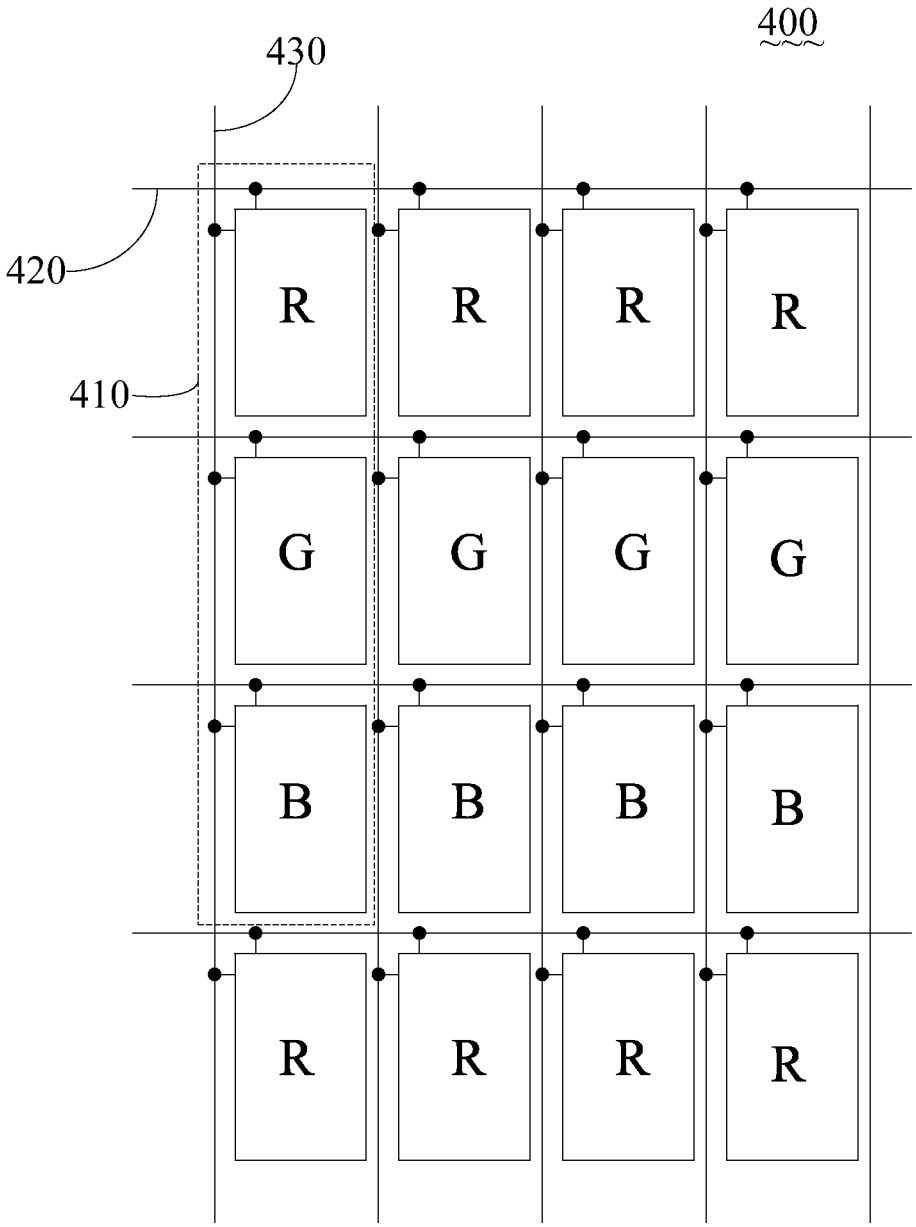
FIG. 4 is a schematic view of an LCD panel of a preferred embodiment according to the present disclosure.

Referring to FIG. 4, a schematic view of an LCD panel of a preferred embodiment according to the present disclosure is shown therein. As shown in FIG. 4, the LCD panel 400 of the present disclosure comprises a plurality of pixels 410, a plurality of scanning lines 420 and a plurality of data lines 430. Each of the pixels 410 comprises an R sub-pixel, a G sub-pixel and a B sub-pixel; each of the scanning lines 420 is electrically connected with a corresponding row of sub-pixels in a row direction; and each of the data lines 430 is electrically connected with a corresponding column of sub-pixels in a column direction. The R sub-pixel, the G sub-pixel and the B sub-pixel of each of the pixels 410 are arranged in the column direction so that the corresponding row of sub-pixels electrically connected with each of the scanning lines 420 are sub-pixels of a same color.

As sub-pixels of a same row are sub-pixels of a same color in the LCD panel 400, a Gamma circuit may be used to provide Gamma reference voltages for sub-pixels of the three different colors R, G, and B in such a way that sub-pixels of an R color row correspond to a Gamma reference voltage of the R color, sub-pixels of a G color row correspond to a Gamma reference voltage of the G color, and sub-pixels of a B color row correspond to a Gamma reference voltage of the B color. Consequently, the LCD panel 400 can overcome the problem of cross-color with the prior art LCD panel and can display colors authentically.

Figure 5:
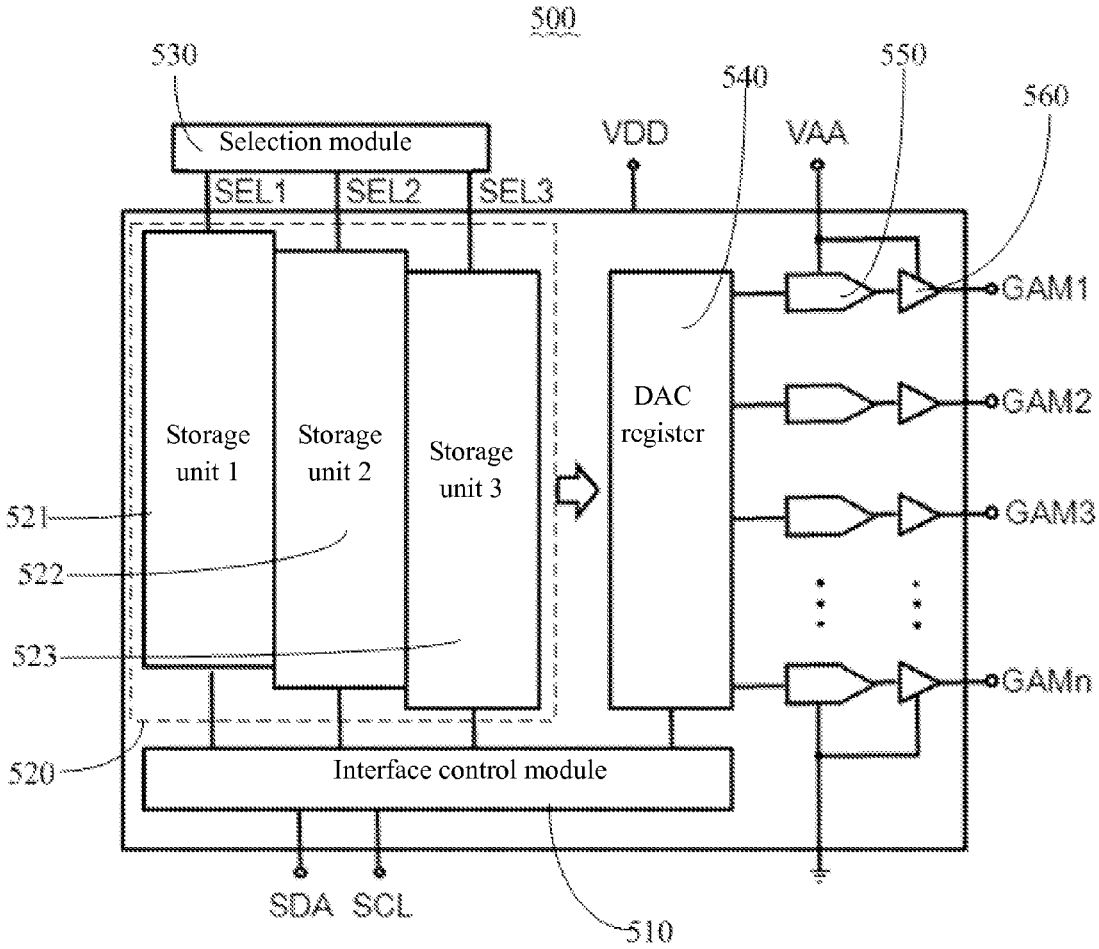
FIG. 5 is a schematic view of a Gamma circuit of a preferred embodiment according to the present disclosure.

FIG. 5 is a schematic view of a Gamma circuit of a preferred embodiment according to the present disclosure. The Gamma circuit can provide Gamma reference voltages corresponding to the different colors of sub-pixels connected with the scanning lines 420 in the LCD panel 400. As shown in FIG. 5, the Gamma circuit 500 may be implemented by a programmable Gamma integrated circuit (IC), and comprises an interface control module 510, a storage module 520, a selection module 530, a digital-to-analog conversion (DAC) register 540, a plurality of DAC modules 550 and a plurality of buffer modules 560.

The interface control module 510 is electrically connected with the storage module 520 and has a data interface SDA and a clock interface SCL, which may be a two-wire data interface and a two-wire clock interface complying with the existing industry standards respectively.

The storage module 520 comprises three storage units 521, 522, and 523, which are configured to store a Gamma voltage conforming to an R color Gamma curve, a Gamma voltage conforming to a G color Gamma curve, and a Gamma voltage conforming to a B color Gamma curve respectively. In applications, the Gamma voltage ideally conforming to the R color Gamma curve, the Gamma voltage ideally conforming to the G color Gamma curve and the Gamma voltage ideally conforming to the B color Gamma curve of the LCD panel 400 are burnt into the storage units 521, 522, and 523 of the storage module 520 respectively via the data interface SDA and the clock interface SCL of the interface control module 510. Furthermore, as will be appreciated by those skilled in the art, serial peripheral interfaces (SPIs) may also be used for the interfaces (i.e., the data interface SDA and the clock interface SCL) of the interface control module 510, which include a data input interface Data-in, a data output interface Data-out, a clock interface Clock and an enable interface Enable. Then, the Gamma voltage ideally conforming to the R color Gamma curve, the Gamma voltage ideally conforming to the G color Gamma curve and the Gamma voltage ideally conforming to the B color Gamma curve can be inputted into the storage units 521, 522, and 523 respectively through the aforesaid interfaces.

The selection module 530 is electrically connected with the storage module 520 to output control selection signals SEL1, SEL2, and SEL3 respectively to the storage units 521, 522, and 523 of the storage module 520 so that a corresponding storage unit is selected according to a timing sequence to output a corresponding Gamma voltage ideally conforming to a certain color Gamma curve.

The DAC register 540 is electrically connected with the storage module 520, and each of the DAC modules 550 is electrically connected between the DAC register 540 and a corresponding one of the buffer modules 560 to convert a Gamma voltage of a digital signal into a Gamma voltage of an analog signal for output via the corresponding buffer module 560. The Gamma voltage of the analog signal serves as the Gamma reference voltage to be outputted. The DAC register 540 is configured to temporarily store the Gamma voltages outputted by the storage module 520 so as to speed up the switching speed between the Gamma voltages conforming to different color Gamma curves.

In this embodiment, the number of the DAC modules 550 and the number of the buffer modules 560 may be designed to be equal to the number of the scanning lines 420 of the LCD panel 400 so that the Gamma reference voltages GAM1/GAM2/GAM3/ . . . /GAMn conforming to different color Gamma curves are outputted respectively corresponding to the colors of the sub-pixels connected with the scanning lines 420 of the LCD panel 400. Therefore, when sub-pixels of a certain row in the LCD panel 400 are R sub-pixels, the Gamma reference voltage outputted by the Gamma circuit 500 is just the Gamma reference voltage conforming to the R color Gamma curve corresponding to the R color Gamma curve. When sub-pixels of a certain row in the LCD panel 400 are G sub-pixels, the Gamma reference voltage outputted by the Gamma circuit 500 is just the Gamma reference voltage conforming to the G color Gamma curve corresponding to the G color Gamma curve. When sub-pixels of a certain row in the LCD panel 400 are B sub-pixels, the Gamma reference voltage outputted by the Gamma circuit 500 is just the Gamma reference voltage conforming to the B color Gamma curve corresponding to the B color Gamma curve.

Figure 6:
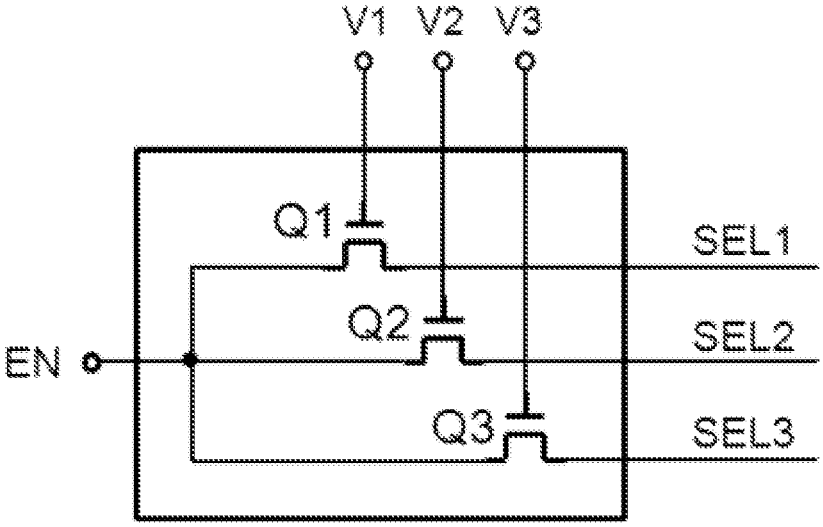
FIG. 6 is a schematic circuit diagram of a selection module shown in FIG. 5.
Figure 7:
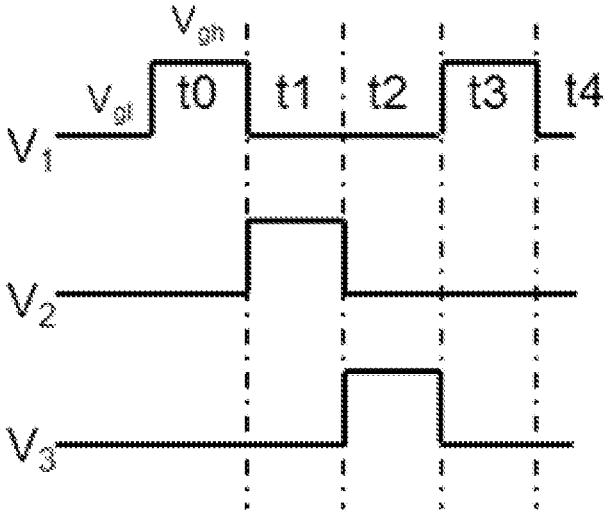
FIG. 7 is a timing diagram of various signals shown in FIG. 6.

FIG. 6 is a schematic circuit diagram of a selection module shown in FIG. 5, and FIG. 7 is a timing diagram of various signals shown in FIG. 6. As shown in FIG. 6 and FIG. 7, the selection module 530 in this embodiment comprises transistors Q1, Q2 and Q3. Each of the transistors Q1, Q2 and Q3 has a gate for receiving control signals V1, V2 and V3, a source connected to an enable signal (EN), and a drain serving as an output of the selection module 530 to output the control selection signals SEL1, SEL2, and SEL3 respectively.

In this embodiment, each of the transistors Q1, Q2 and Q3 is an NMOS transistor, and the control signals V1, V2 and V3 are alternating current (AC) voltages. The transistors Q1, Q2 and Q3 are alternately turned on according to a timing sequence under the control of the control signals V1, V2 and V3, and the turn-on time of each of the transistors Q1, Q2 and Q3 corresponds to the turn-on time (i.e., the charging time) of sub-pixels of an arbitrary row in the LCD panel 400. As shown in FIG. 7, t0=t1=t2=t3, and each of the time durations t0, t1, t2 and t3 corresponds to the turn-on time of sub-pixels of an arbitrary row in the LCD panel 400. In the time duration t0, because V1 is at a high level and V2 and V3 are at a low level, the transistor Q1 is turned on and the transistors Q2 and Q3 are turned off. Therefore, the control selection signal SEL1 outputted is at a high level while the control selection signals SEL2 and SEL3 are at a low level; in other words, the first storage unit 521 is selected to output the ideal Gamma voltage of the R color. In the time duration t1, because V2 is at a high level and V1 and V3 are at a low level, the transistor Q2 is turned on and the transistors Q1 and Q3 are turned off. Therefore, the control selection signal SEL2 outputted is at a high level while the control selection signals SEL1 and SEL3 are at a low level; in other words, the second storage unit 522 is selected to output the ideal Gamma voltage of the G color. In the time duration t2, because the V3 is at a high level and the V1 and the V2 are at a low level, the transistor Q3 is turned on and the transistors Q1 and Q2 are turned off. Therefore, the control selection signal SEL3 outputted is at a high level while the control selection signals SEL1 and SEL2 are at a low level; in other words, the third storage unit 523 is selected to output the ideal Gamma voltage of the B color. In the time duration t3, again the transistor Q1 is turned on and the transistors Q2 and Q3 are turned off, and then the aforesaid cycle proceeds repeatedly to output the Gamma reference voltages for sub-pixels of all rows. Therefore, the present disclosure can use the Gamma circuit to output the Gamma reference voltages conforming to Gamma curves corresponding to colors of sub-pixels of different rows respectively. Thereby, each sub-pixel will correspond to a Gamma curve of its real color of one of the three primary colors R, G and B, thus obviating the color-cross.

According to the above descriptions, in the LCD panel of the present disclosure, the R sub-pixel, the G sub-pixel and the B sub-pixel of each pixel are arranged in the column direction so that a row of sub-pixels electrically connected with each scanning line are all sub-pixels of a same color; and then a Gamma circuit is used to provide a Gamma reference voltage conforming to a corresponding color Gamma curve for the sub-pixels of the same color in each row. Thereby, each sub-pixel will correspond to a Gamma curve of its real color of one of the three primary colors R, G and B, thus obviating the color-cross.

Furthermore, the present disclosure further provides an LCD device, which comprises the LCD panel as shown in FIG. 4 and the Gamma circuit shown in FIG. 5 to FIG. 7 to obviate the color-cross. In addition, as will be appreciated by those skilled in the art, the LCD panel of the present disclosure may also be another kind of color flat display panel such as an electrophoresis display panel or an electrowetting display panel, and correspondingly, the LCD device of the present disclosure may also be another kind of color flat display device. Of course, as will be appreciated by those skilled in the art, although the embodiments of the present disclosure adopt the commonly used three primary colors R, G and B to illustrate the present disclosure, the present disclosure may also adopt a combination of other primary colors.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A color flat display panel, comprising:

a plurality of pixels each comprising a first color sub-pixel, a second color sub-pixel and a third color sub-pixel, wherein the first color is a red (R) color, the second color is a green (G) color and the third color is a blue (B) color;

a plurality of scanning lines, each of the scanning lines being electrically connected with a corresponding row of sub-pixels in a row direction; and a plurality of data lines, each of the data lines being electrically connected with a corresponding column of sub-pixels in a column direction;

wherein the first color sub-pixel, the second color sub-pixel and the third color sub-pixel of each of the pixels are arranged in the column direction so that the corresponding row of sub-pixels electrically connected with each of the scanning lines are sub-pixels of a same color; and the color flat display panel uses a Gamma circuit to provide Gamma reference voltages for different colors, and the Gamma reference voltages correspond to the colors of the corresponding rows of sub-pixels electrically connected with the scanning lines;

wherein the Gamma circuit comprises:

an interface control module;

a storage module comprising a first storage unit, a second storage unit and a third storage unit, wherein the storage module is configured to receive a Gamma voltage conforming to a first color Gamma curve, a Gamma voltage conforming to a second color Gamma curve and a Gamma voltage conforming to a third color Gamma curve for the color flat display panel via the interface control module, and store the Gamma voltage conforming to the first color Gamma curve, the Gamma voltage conforming to the second color Gamma curve and the Gamma voltage conforming to the third color Gamma curve into the first storage unit, the second storage unit and the third storage unit of the storage module respectively;

a selection module, being configured to select one of the first storage unit, the second storage unit and the third storage unit according to a timing sequence so that the Gamma voltage conforming to the first color Gamma curve, the Gamma voltage conforming to the second color Gamma curve and the Gamma voltage conforming to the third color Gamma curve are outputted according to the timing sequence;

a digital-to-analog conversion (DAC) register, being configured to temporarily store the Gamma voltage conforming to the first color Gamma curve, the Gamma voltage conforming to the second color Gamma curve and the Gamma voltage conforming to the third color Gamma curve outputted by the storage module;

a plurality of DAC modules, being electrically connected to the DAC register respectively, wherein each of the DAC modules is configured to receive a Gamma voltage of one color and convert the Gamma voltage of the color from a digital signal into an analog signal for use as the Gamma reference voltage of the corresponding color; and a plurality of buffers, each of which is electrically connected with a corresponding one of the DAC modules to output the Gamma reference voltage of the corresponding color;

wherein the number of the DAC modules and the number of the buffers correspond to the number of the scanning lines of the color flat display panel, and the Gamma reference voltage of the corresponding color outputted by each of the buffers corresponds to the color of the corresponding row of sub-pixels electrically connected with a corresponding one of the scanning lines.

2. The color flat display panel of claim 1, wherein the selection module comprises a first transistor, a second transistor and a third transistor, and each of the transistors has a gate for receiving a corresponding control signal, a source electrically connected to an enable signal, and a drain for outputting a control selection signal to one of the first storage unit, the second storage unit and the third storage unit.

3. The color flat display panel of claim 2, wherein the color flat display panel is a liquid crystal display (LCD) panel.

4. A color flat display panel, comprising:

a plurality of pixels each comprising a first color sub-pixel, a second color sub-pixel and a third color sub-pixel;

a plurality of scanning lines, each of the scanning lines being electrically connected with a corresponding row of sub-pixels in a row direction; and a plurality of data lines, each of the data lines being electrically connected with a corresponding column of sub-pixels in a column direction;

wherein the first color sub-pixel, the second color sub-pixel and the third color sub-pixel of each of the pixels are arranged in the column direction so that the corresponding row of sub-pixels electrically connected with each of the scanning lines are sub-pixels of a same color;

wherein the color flat display panel uses a Gamma circuit to provide Gamma reference voltages for different colors, and the Gamma reference voltages correspond to the colors of the corresponding rows of sub-pixels electrically connected with the scanning lines;

wherein the Gamma circuit comprises:

an interface control module;

a storage module comprising a first storage unit, a second storage unit and a third storage unit, wherein the storage module is configured to receive a Gamma voltage conforming to a first color Gamma curve, a Gamma voltage conforming to a second color Gamma curve and a Gamma voltage conforming to a third color Gamma curve for the color flat display panel via the interface control module, and store the Gamma voltage conforming to the first color Gamma curve, the Gamma voltage conforming to the second color Gamma curve and the Gamma voltage conforming to the third color Gamma curve into the first storage unit, the second storage unit and the third storage unit of the storage module respectively;

a selection module, being configured to select one of the first storage unit, the second storage unit and the third storage unit according to a timing sequence so that the Gamma voltage conforming to the first color Gamma curve, the Gamma voltage conforming to the second color Gamma curve and the Gamma voltage conforming to the third color Gamma curve are outputted according to the timing sequence;

a digital-to-analog conversion (DAC) register, being configured to temporarily store the Gamma voltage conforming to the first color Gamma curve, the Gamma voltage conforming to the second color Gamma curve and the Gamma voltage conforming to the third color Gamma curve outputted by the storage module;

a plurality of DAC modules, being electrically connected to the DAC register respectively, wherein each of the DAC modules is configured to receive a Gamma voltage of one color and convert the Gamma voltage of the color from a digital signal into an analog signal for use as the Gamma reference voltage of the corresponding color; and a plurality of buffers, each of which is electrically connected with a corresponding one of the DAC modules to output the Gamma reference voltage of the corresponding color;

wherein the number of the DAC modules and the number of the buffers correspond to the number of the scanning lines of the color flat display panel, and the Gamma reference voltage of the corresponding color outputted by each of the buffers corresponds to the color of the corresponding row of sub-pixels electrically connected with a corresponding one of the scanning lines.

5. The color flat display panel of claim 4, wherein the selection module comprises a first transistor, a second transistor and a third transistor, and each of the transistors has a gate for receiving a corresponding control signal, a source electrically connected to an enable signal, and a drain for outputting a control selection signal to one of the first storage unit, the second storage unit and the third storage unit.

6. The color flat display panel of claim 4, wherein the color flat display panel is an LCD (liquid crystal display) panel.

7. A color flat display device, comprising:

a color flat display panel, comprising:

a plurality of pixels each comprising a first color sub-pixel, a second color sub-pixel and a third color sub-pixel;

a plurality of scanning lines, each of the scanning lines being electrically connected with a corresponding row of sub-pixels in a row direction; and a plurality of data lines, each of the data lines being electrically connected with a corresponding column of sub-pixels in a column direction; and a Gamma circuit;

wherein the first color sub-pixel, the second color sub-pixel and the third color sub-pixel of each of the pixels in the color flat display panel are arranged in the column direction so that the corresponding row of sub-pixels electrically connected with each of the scanning lines are sub-pixels of a same color; and the Gamma circuit is configured to provide the color flat display panel with Gamma reference voltages for different colors, and the Gamma reference voltages correspond to the colors of the corresponding rows of sub-pixels electrically connected with the scanning lines;

wherein the Gamma circuit comprises:

an interface control module;

a storage module comprising a first storage unit, a second storage unit and a third storage unit, wherein the storage module is configured to receive a Gamma voltage conforming to a first color Gamma curve, a Gamma voltage conforming to a second color Gamma curve and a Gamma voltage conforming to a third color Gamma curve for the color flat display panel via the interface control module, and store the Gamma voltage conforming to the first color Gamma curve, the Gamma voltage conforming to the second color Gamma curve and the Gamma voltage conforming to the third color Gamma curve into the first storage unit, the second storage unit and the third storage unit of the storage module respectively;

a selection module, being configured to select one of the first storage unit, the second storage unit and the third storage unit according to a timing sequence so that the Gamma voltage conforming to the first color Gamma curve, the Gamma voltage conforming to the second color Gamma curve and the Gamma voltage conforming to the third color Gamma curve are outputted according to the timing sequence;

a digital-to-analog conversion (DAC) register, being configured to temporarily store the Gamma voltage conforming to the first color Gamma curve, the Gamma voltage conforming to the second color Gamma curve and the Gamma voltage conforming to the third color Gamma curve outputted by the storage module;

a plurality of DAC modules, being electrically connected to the DAC register respectively, wherein each of the DAC modules is configured to receive a Gamma voltage of one color and convert the Gamma voltage of the color from a digital signal into an analog signal for use as the Gamma reference voltage of the corresponding color; and a plurality of buffers, each of which is electrically connected with a corresponding one of the DAC modules to output the Gamma reference voltage of the corresponding color;

wherein the number of the DAC modules and the number of the buffers correspond to the number of the scanning lines of the color flat display panel, and the Gamma reference voltage of the corresponding color outputted by each of the buffers corresponds to the color of the corresponding row of sub-pixels electrically connected with a corresponding one of the scanning lines.

8. The color flat display device of claim 7, wherein the selection module comprises a first transistor, a second transistor and a third transistor, and each of the transistors has a gate for receiving a corresponding control signal, a source electrically connected to an enable signal, and a drain for outputting a control selection signal to one of the first storage unit, the second storage unit and the third storage unit.

9. The color flat display device of claim 7, wherein the interface control module comprises a data interface and a clock interface, the Gamma voltage conforming to the first color Gamma curve, the Gamma voltage conforming to the second color Gamma curve and the Gamma voltage conforming to the third color Gamma curve are written into the first storage unit, the second storage unit and the third storage unit of the storage module respectively via the data interface and the clock interface of the interface control module.

* * * * *